US009328990B2

(12) United States Patent
Giannelli et al.

(10) Patent No.: US 9,328,990 B2
(45) Date of Patent: May 3, 2016

(54) LEVER-ACTION MODULAR TACTICAL RIFLE

(71) Applicants: Chance Giannelli, Hope Mills, NC (US); John W. Kieckhefer, Prescott, AZ (US); Harrison Tobin, Flower Mound, TX (US); Jacques A. Nevils, Fairview, TX (US)

(72) Inventors: Chance Giannelli, Hope Mills, NC (US); John W. Kieckhefer, Prescott, AZ (US); Harrison Tobin, Flower Mound, TX (US); Jacques A. Nevils, Fairview, TX (US)

( * ) Notice: Subject to any disclaimer, the term of this patent is extended or adjusted under 35 U.S.C. 154(b) by 10 days.

(21) Appl. No.: 14/452,492

(22) Filed: Aug. 5, 2014

(65) Prior Publication Data

US 2016/0040956 A1 Feb. 11, 2016

(51) Int. Cl.
*F41C 7/06* (2006.01)

(52) U.S. Cl.
CPC ..... *F41C 7/06* (2013.01)

(58) Field of Classification Search
CPC ..... F41A 3/00; F41A 3/12; F41A 3/18; F41A 3/22; F41A 3/24; F41A 3/42; F41A 3/48; F41A 3/52; F41A 7/00; F41A 9/01; F41A 19/00; F41A 7/06
USPC ..... 42/16, 17, 18, 20, 21; 89/125, 128, 180, 89/187.01, 188, 191.01, 199
See application file for complete search history.

(56) References Cited

U.S. PATENT DOCUMENTS

| | | | | | |
|---|---|---|---|---|---|
| 2,501,137 | A * | 3/1950 | Minasola | F41C 7/06 | 42/16 |
| 2,881,547 | A * | 4/1959 | Butler | F41A 3/18 | 42/16 |
| 3,257,749 | A * | 6/1966 | Donaldson | F41A 3/42 | 42/16 |
| 3,302,523 | A * | 2/1967 | Adams | B25C 1/12 | 42/39.5 |
| 4,213,261 | A * | 7/1980 | Claypool | F41A 3/40 | 42/16 |
| 5,900,577 | A * | 5/1999 | Robinson | F41A 11/02 | 89/156 |
| 6,634,274 | B1 * | 10/2003 | Herring | F41A 5/26 | 89/191.01 |
| 7,596,900 | B2 * | 10/2009 | Robinson | F41A 33/06 | 42/49.01 |
| 2011/0061523 | A1 * | 3/2011 | Webb | F41A 3/42 | 89/128 |
| 2011/0083551 | A1 * | 4/2011 | Sirochman | F41A 3/72 | 89/191.01 |
| 2013/0061737 | A1 * | 3/2013 | Brown | F41A 3/72 | 89/1.4 |
| 2014/0224114 | A1 * | 8/2014 | Faxon | F41A 15/14 | 89/193 |

* cited by examiner

*Primary Examiner* — Bret Hayes

(57) ABSTRACT

A lever-action tactical rifle having an upper receiver assembly having a rifle barrel and a hand-guard. A lower receiver releasably and pivotally connected with the upper receiver and having a butt-stock and a magazine receptacle releasably containing a cartridge magazine. A bolt mechanism having a bolt carrier and a bolt member and firing pin being located for reciprocating movement within the upper receiver. A lever-action mechanism is mounted to the lower receiver and is connected with the bolt carrier by an actuating linkage. The bolt member has cam slots being engaged by cam pins of the bolt carrier to translate linear movement of the bolt carrier to rotation of the bolt for bolt locking and unlocking.

16 Claims, 15 Drawing Sheets

LEVER-ACTION MODULAR TACTICAL RIFLE

BACKGROUND OF THE INVENTION

1. Field of the Invention

The present invention relates generally to lever-action rifles. More particularly, the present invention concerns a rifle mechanism that incorporates several of the design and functional features of well-known tactical rifles, such as the AR-15 semi-automatic auto-loading firearm, but rather than having a semi-automatic cartridge handling mechanism, incorporates a lever-action mechanism permitting manually actuated cartridge loading, firing and cartridge case extraction and ejection. More particularly, the present invention concerns a rather short or compact, manually operated lever-action rifle that can be easily handled during field conditions to provide enjoyable shooting for a wide range of users. This invention also concerns rifles and other firearms that are of modular construction, facilitating matching of upper receivers having various calibers of barrels to a lower receiver mechanism.

2. Description of the Prior Art

Lever-action rifles have been manufactured and sold since the 1800s and have been popular for many years. Such rifles and are currently being manufactured and widely sold by Winchester Repeating Arms, 275 Winchester Avenue, Morgan Utah 84050, Sturm Ruger & Co., Savage Arms, Inc. of Westfield Mass., the O. F. Mossberg & Sons, Inc. of North Haven Mass. and the Marlin Firearms Company, formerly of North Haven, Conn. and now owned by Remington. Lever action firearms are manufactured and sold by a number of other firearms manufacturers in the United States and elsewhere.

SUMMARY OF THE INVENTION

It is a principal feature of the present invention to provide a novel rifle mechanism having the general appearance of an autoloading tactical rifle, but having a lever-action mechanism for manually actuated cartridge loading, firing and cartridge case extraction and ejection.

It is another feature of the present invention to provide a novel lever-action rifle that is generally provided on an AR-15 platform to provide a tactical appearance and providing manually operated lever-action characteristics for shooting enjoyment.

It is also a feature of the present invention to provide a novel lever-action rifle that incorporates separate upper and lower receiver sections that are pivotally connected and can easily be separated for efficiency of cleaning and servicing as well as for ease of storage and transportation.

It is an even further feature of the present invention to provide a novel lever-action rifle of modular character to facilitate connection of differing upper receivers to facilitate ease of changing to upper receiver assemblies having different center-fire calibers.

Another feature of the present invention involves the use of a bolt carrier and bolt within an upper receiver that are driven by a lever-action mechanism for picking up a cartridge from an AR type cartridge magazine, inserting the cartridge within a cartridge chamber of the rifle barrel and after having fired the cartridge, extracting the spent cartridge case from the cartridge chamber and ejecting it through an ejection port of the upper receiver.

Briefly, the various objects and features of the present invention are realized through the provision of a lever-action rifle having an upper receiver assembly that is pivotally and removably mounted to a lower receiver assembly by a removable pivot pin and a removable locking pin, thus permitting separation of the upper and lower receivers. The upper and lower receivers have many of the attributes of an AR-15 auto-loading platform and can be simply and efficiently separated for cleaning and other servicing or for replacement of the upper receiver assembly for change to a different caliber or for efficient storage or for any other desired purpose.

The lower receiver defines a standard generally rectangular magazine receptacle for releasably receiving a commercially available AR type cartridge magazine containing readily available center-fire cartridges such as 5.56/.223. However, it is not intended that the firearm of the present invention be limited in any way to the use of any particular type or caliber of cartridges.

The rifle of the present invention is provided with a familiar manually controlled lever-action cartridge handling mechanism which provides the user with the capability for execution of quick follow-up shots as compared with manually operated rifles, such as a bolt action type rifle. Unlike firearms having a semi-automatic gas-operated cartridge handling systems that need frequent cleaning for satisfactory use during field conditions, the lever-action cartridge handling system is seldom affected by harsh conditions and can function quite adequately during long periods of use without the necessity of stopping for cleaning and other servicing.

The upper receiver of this lever-action rifle mechanism is provided with a sight mount rail of the Picatinny or Weaver type, thus permitting efficient mounting of a wide variety of optics to the rifle. The sight mount rail can be integral with the upper receiver or it may be in the form of an addition that is mounted to the upper receiver by screws or other retainer devices.

A bolt carrier having a generally square or rectangular cross-sectional configuration is mounted for linear reciprocating movement relative to the upper and lower receiver assemblies by means of a lever-action mechanism, rather than employing the usual semi-automatic auto-loading system that is the characteristic of AR-15 type rifles. The lever-action rifle employs an AR-15 type lower receiver having a trigger bar safety. Within the bolt carrier is mounted a bolt mechanism that is rotated for locking and unlocking movement by means of one or more cam pins that are mounted to the bolt carrier and are received by cam pin slots of the bolt member.

Conventionally a bolt of a rifle or similar firearm is rotated for locking and unlocking movement by means of cam surfaces that are defined by the interior of a bolt carrier. In accordance with the present invention, however, the bolt member defines cam slots which are engaged by cam pins that are mounted to the bolt carrier. A firing pin is mounted for limited reciprocating movement within an internal longitudinal passage of the bolt member and is retained against separation from the bolt member by a vertically oriented locking pin retainer pin. The rear end of the bolt carrier defines a concave curved end surface and has a bolt opening permitting lubrication and other servicing of the bolt carrier, bolt and firing pin.

The lever-action rifle of the present invention employs a free-floating barrel in a lever-action rifle design and incorporates a hand-guard that is securely mounted to the upper receiver and is stabilized by a front portion of the rifle barrel. The rifle of this invention is preferably provided with a synthetic or composite stock that enables handling of the rifle in harsh conditions that would be harmful to wood stocks. This feature allows the firearm to better retain its accuracy when used as a utility rifle during a wide range of field conditions.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

IN THE DRAWINGS

Figure 1:
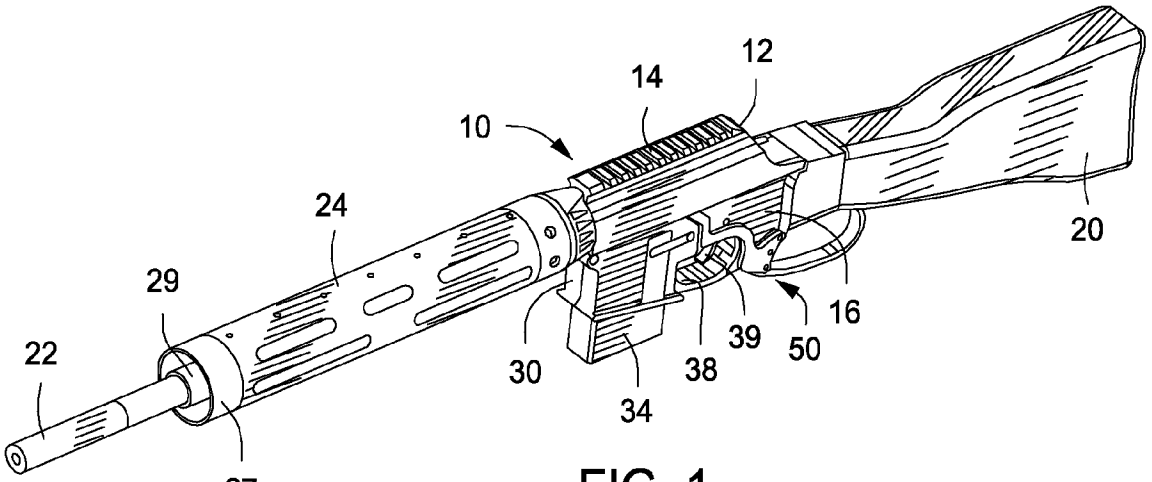
Figure 2:
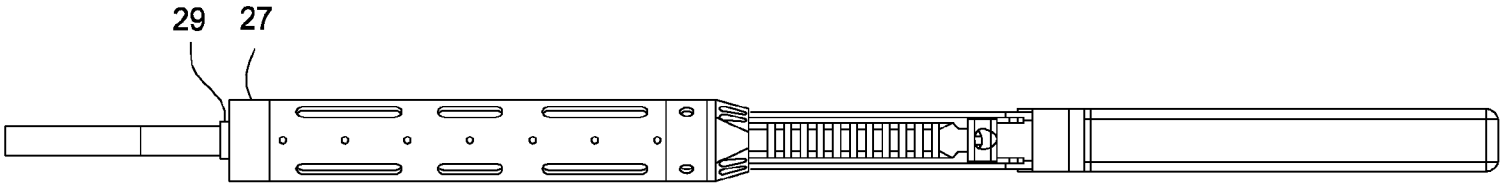
Figure 3:
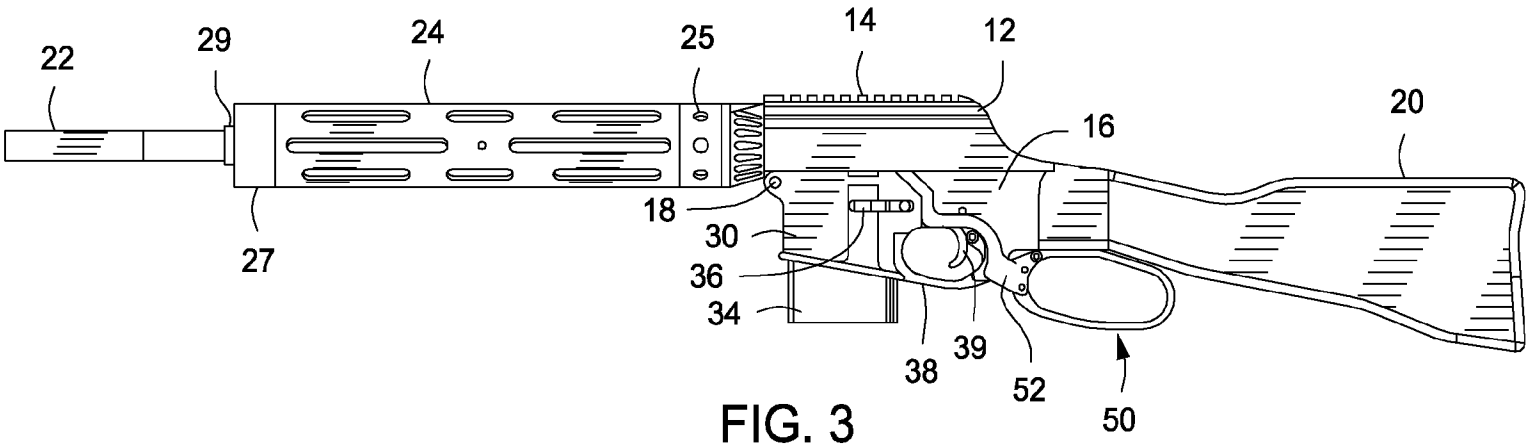
Figure 4:
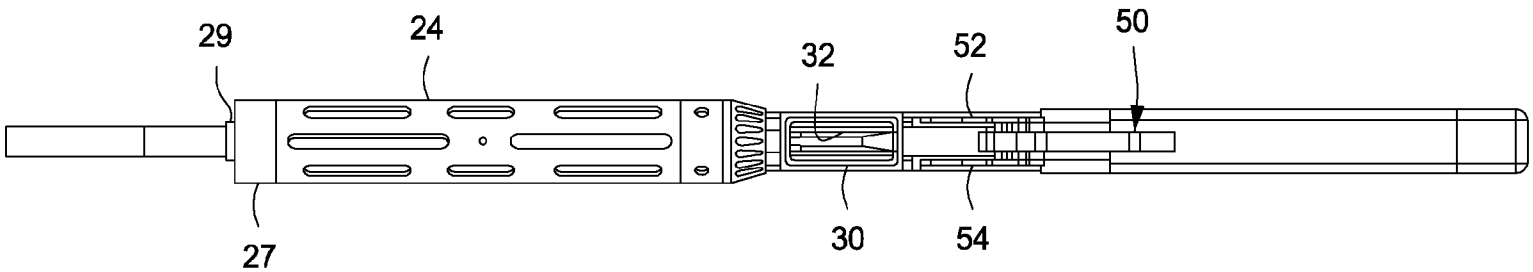
Figure 5:
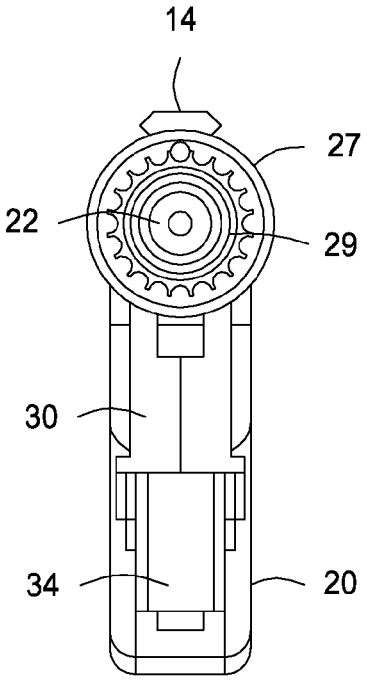
Figure 6:
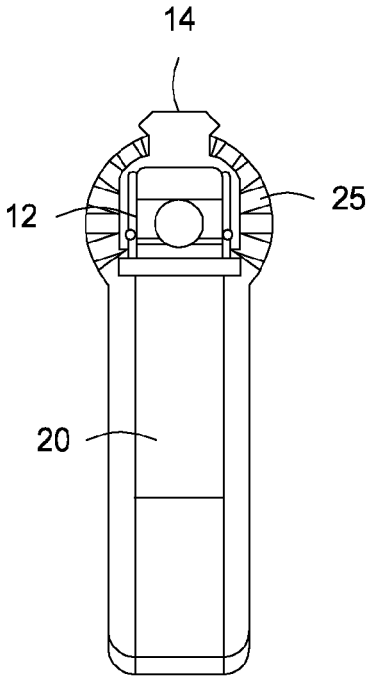
Figure 7:
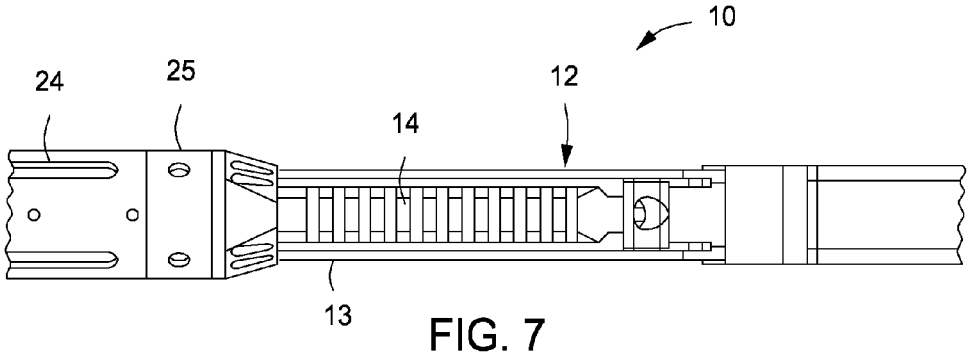
Figure 8:
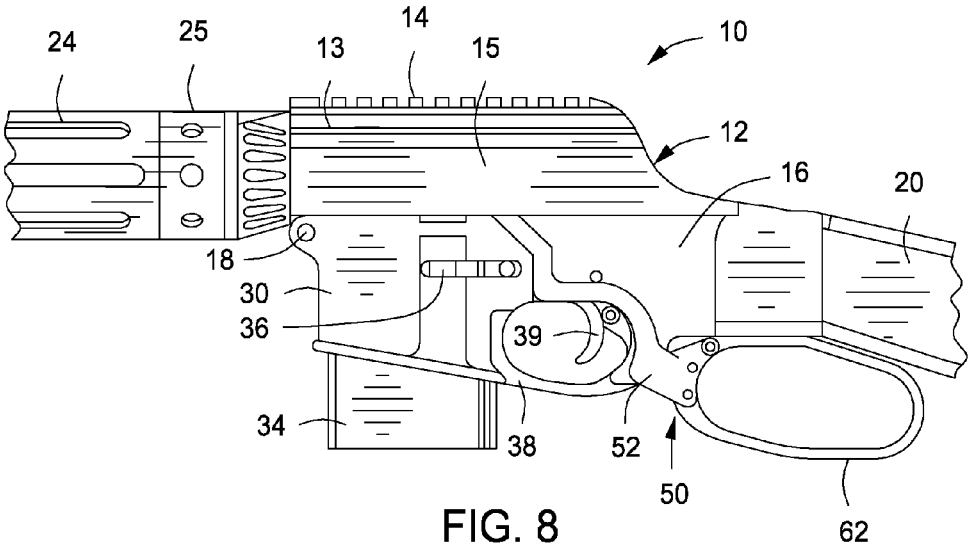
Figure 9:
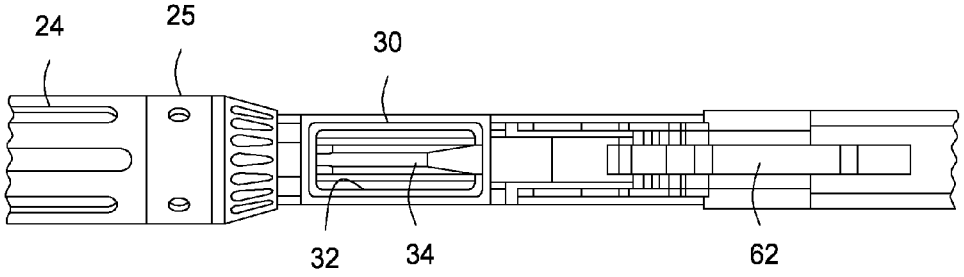
Figure 10:
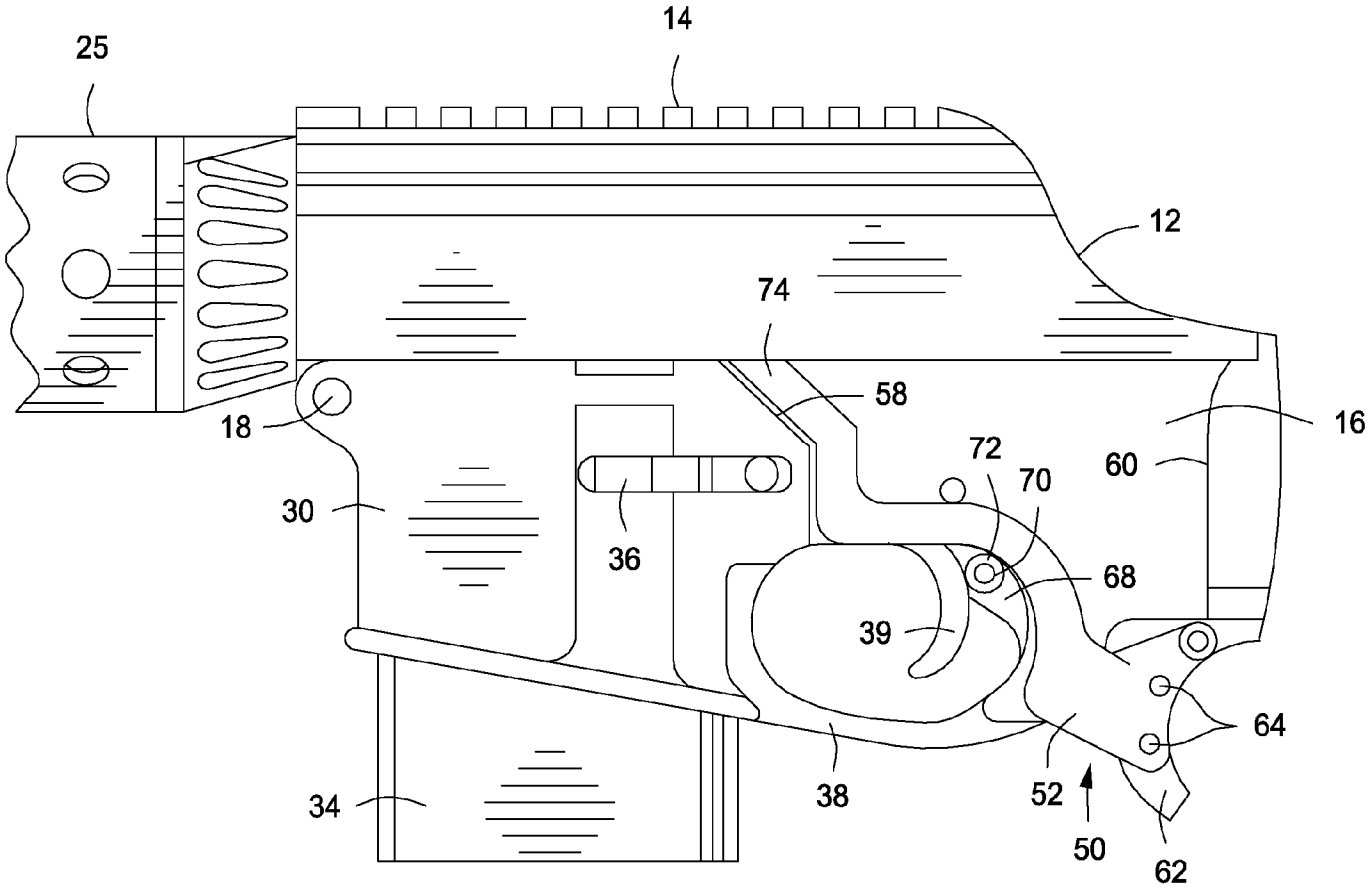
Figure 11:
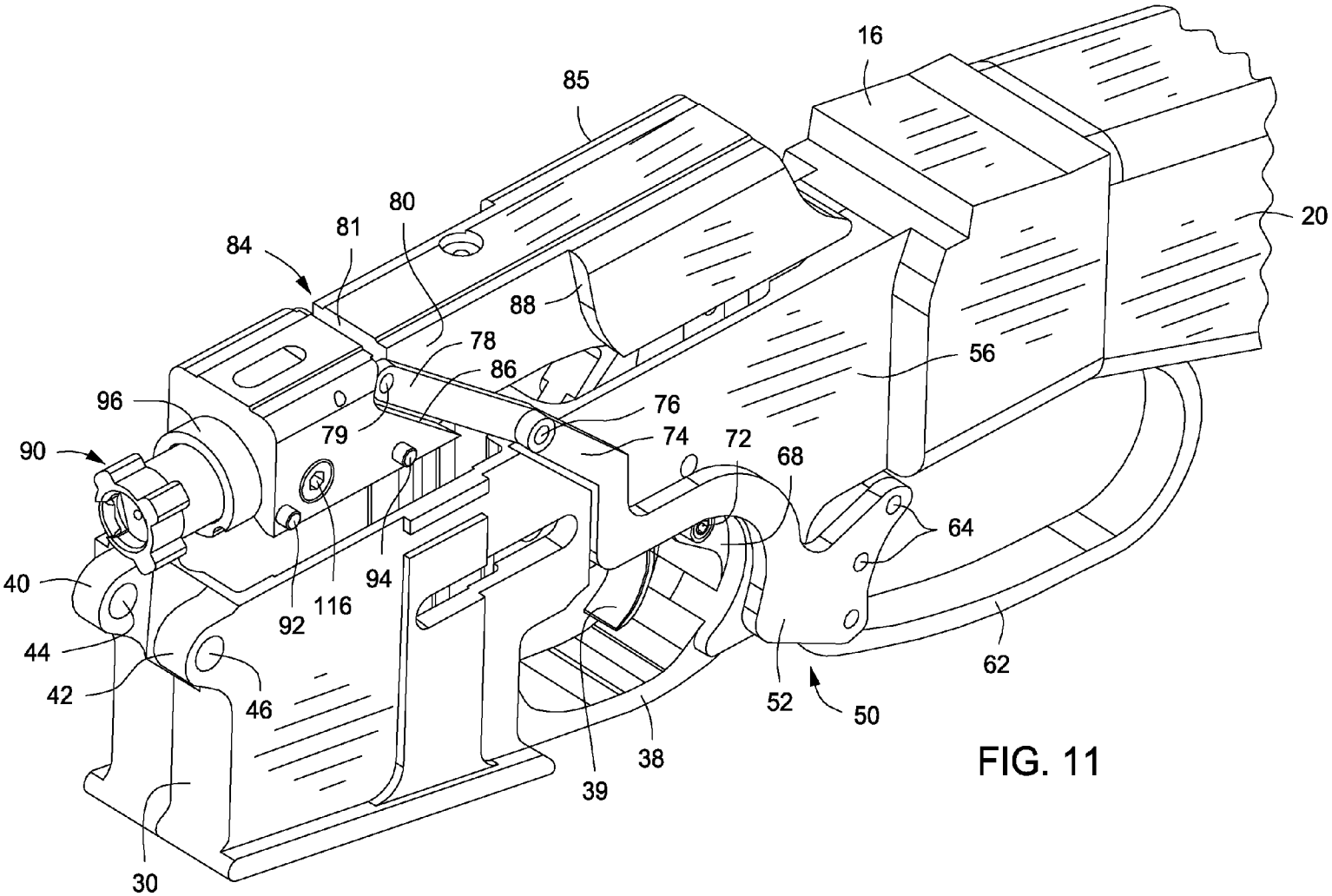
Figure 12:
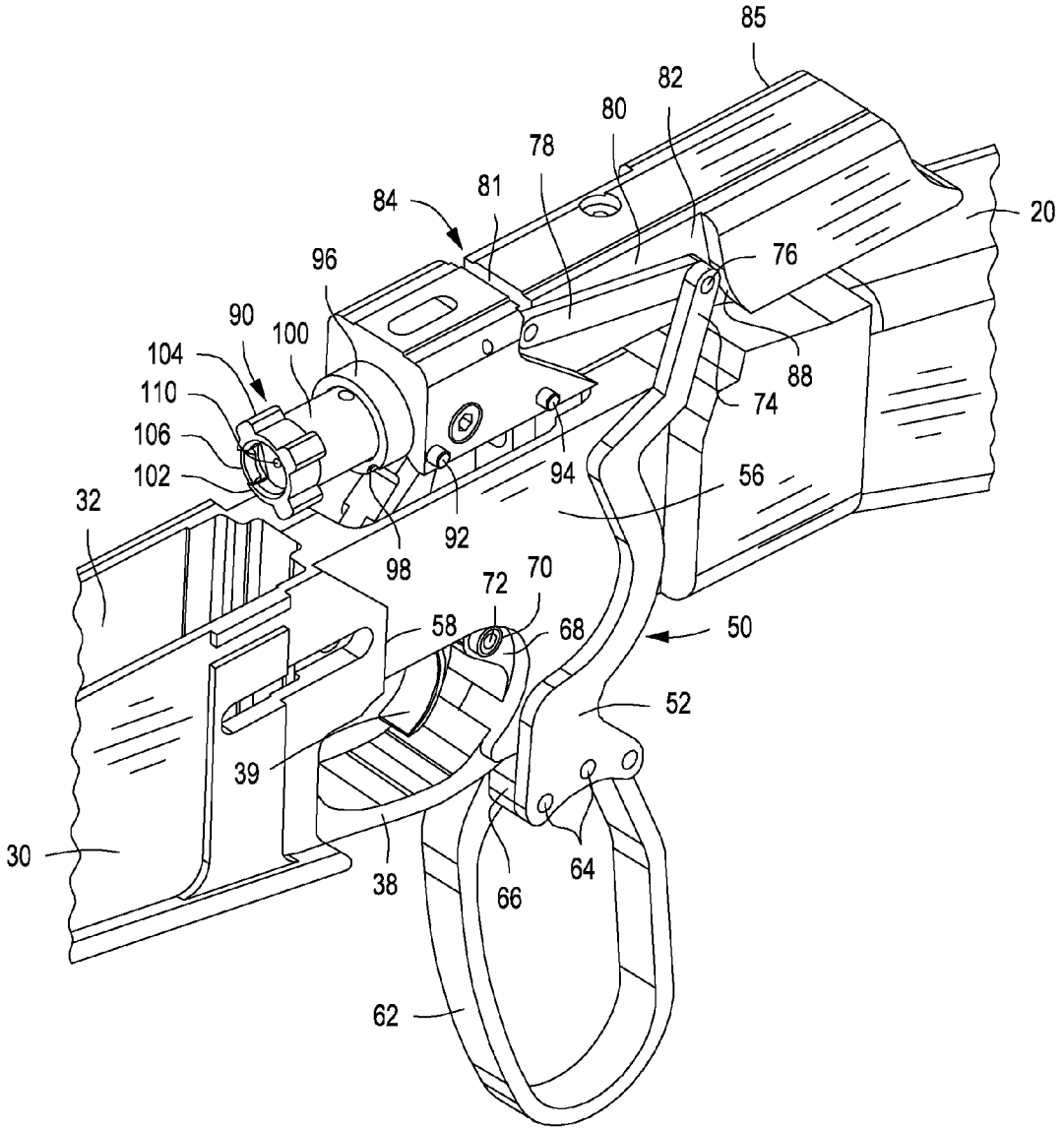
Figure 13:
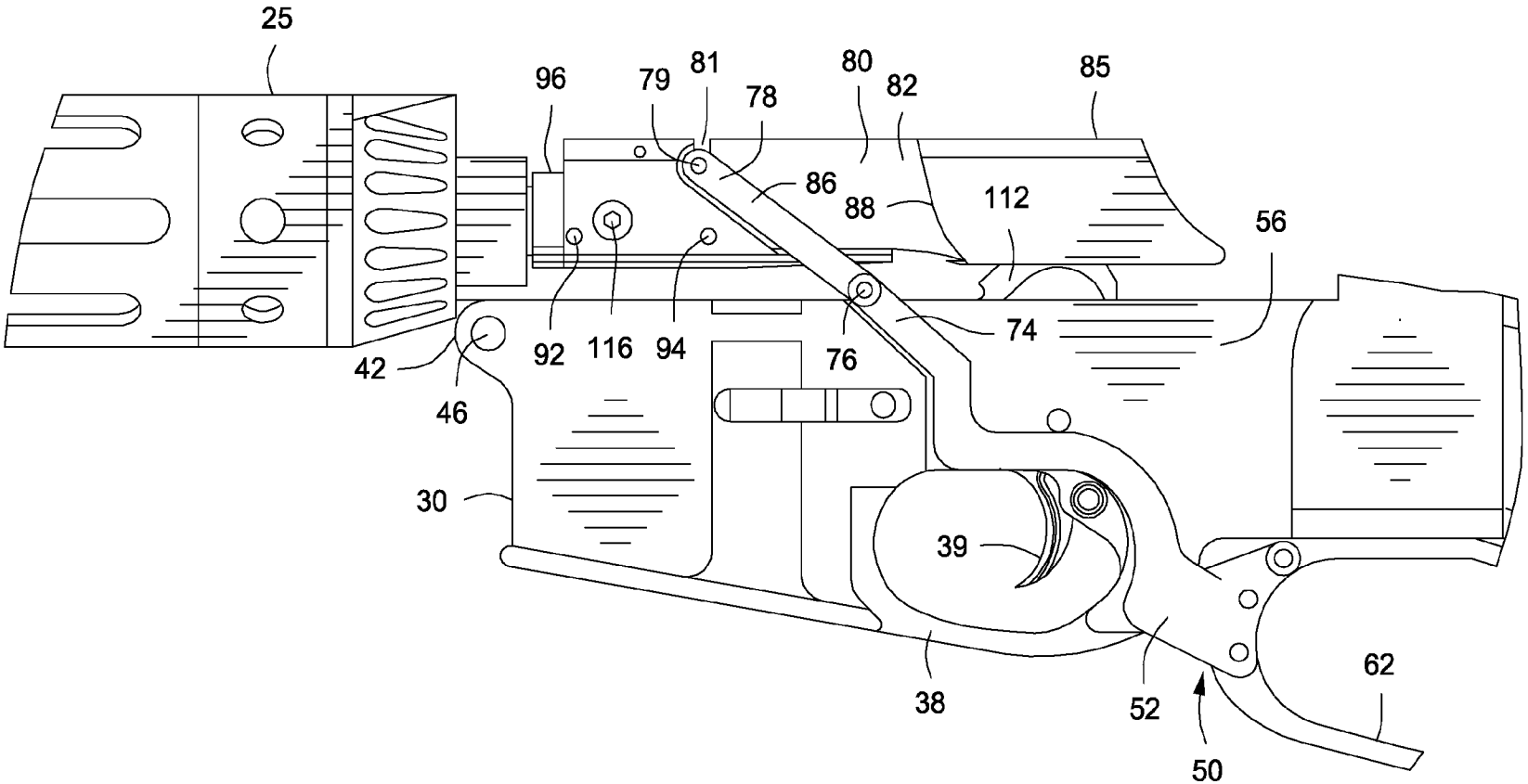
Figure 14:
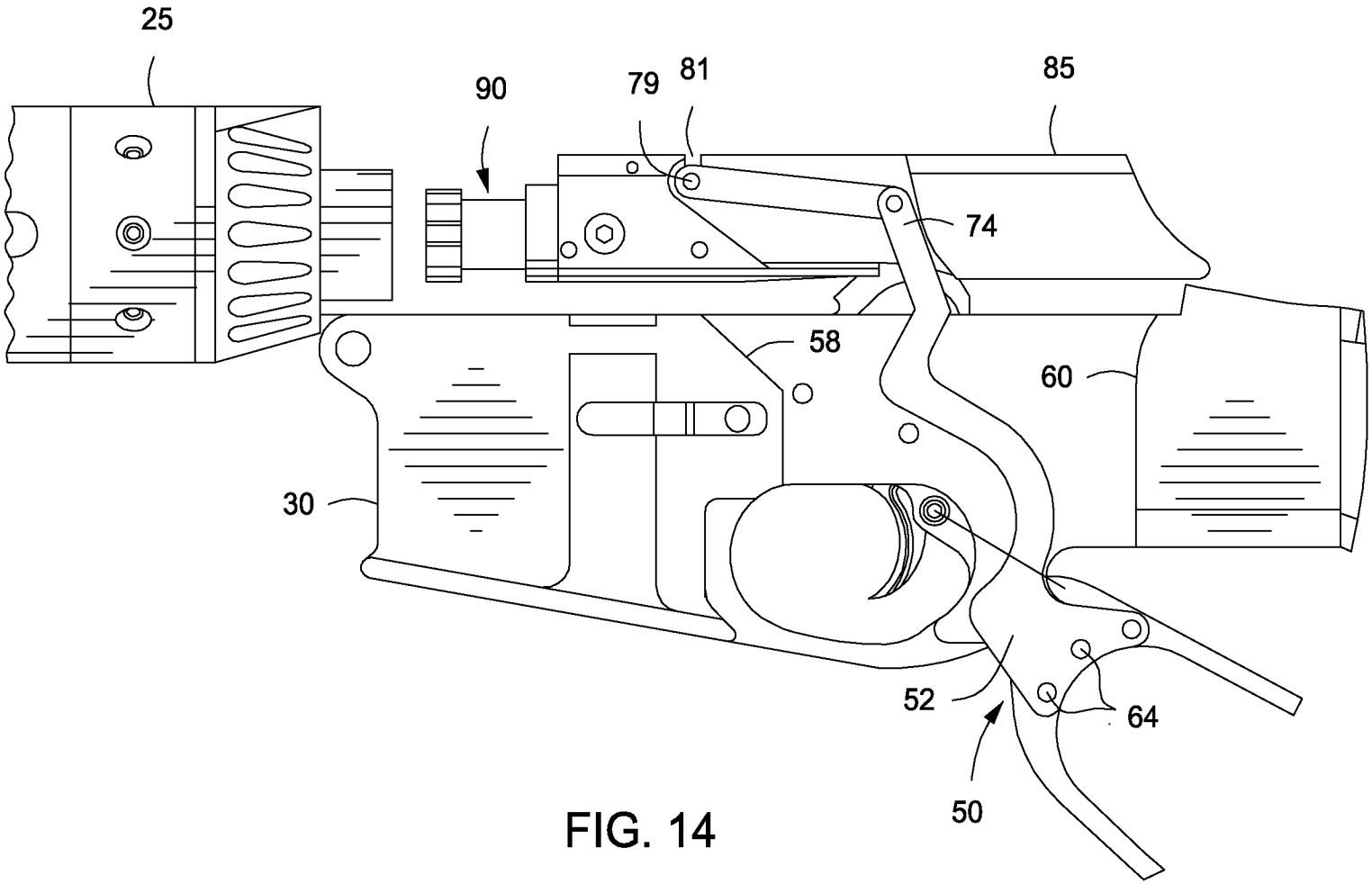
Figure 15:
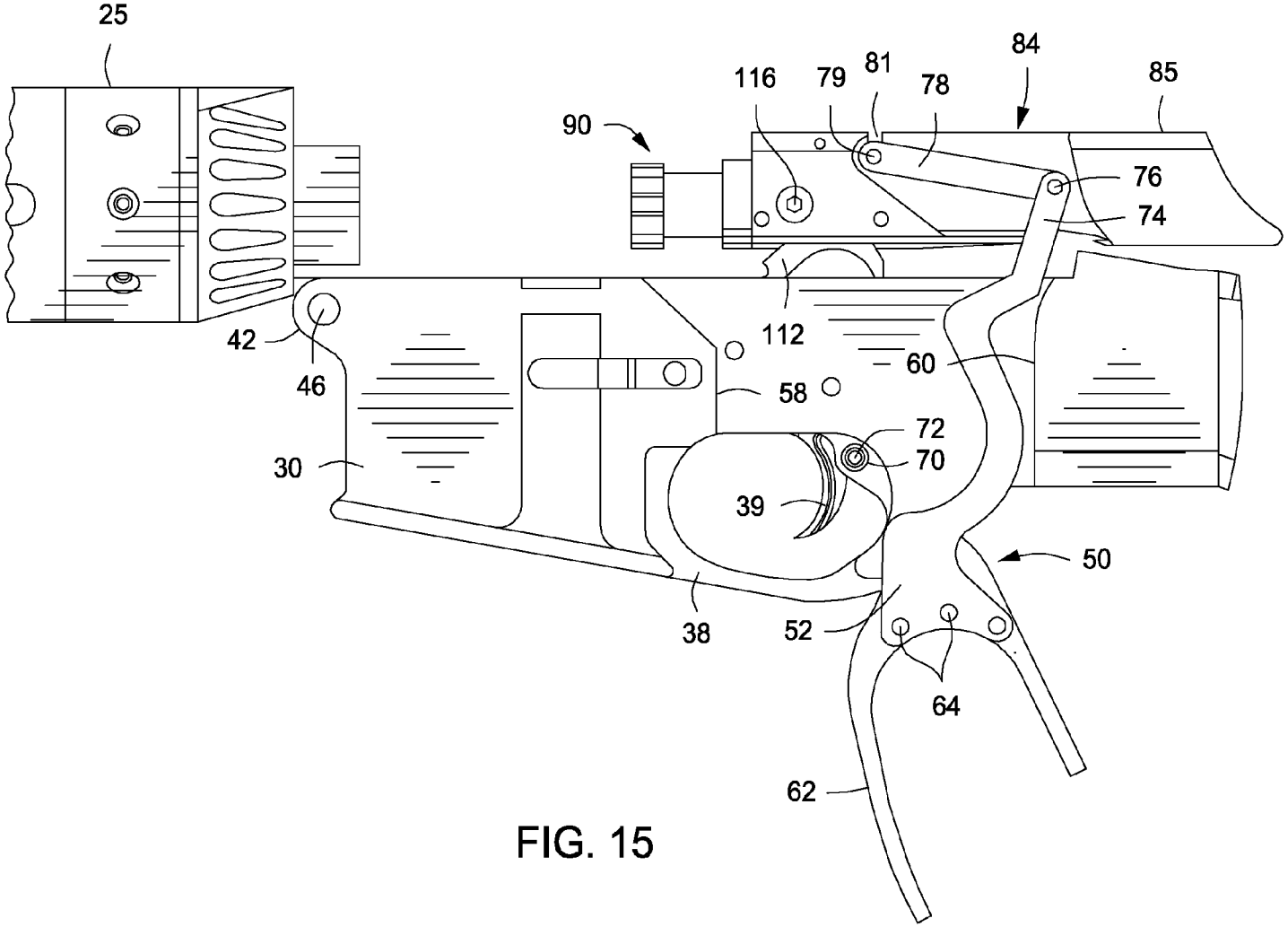
Figure 16:
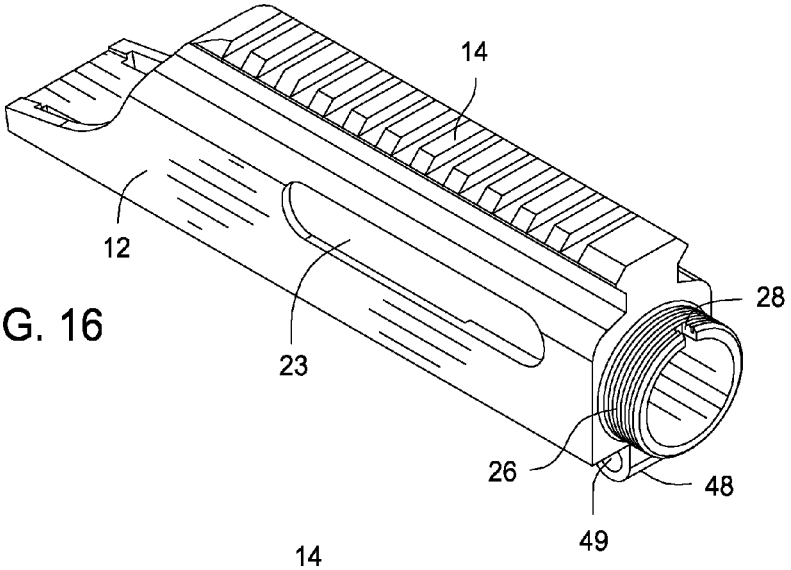
Figure 17:
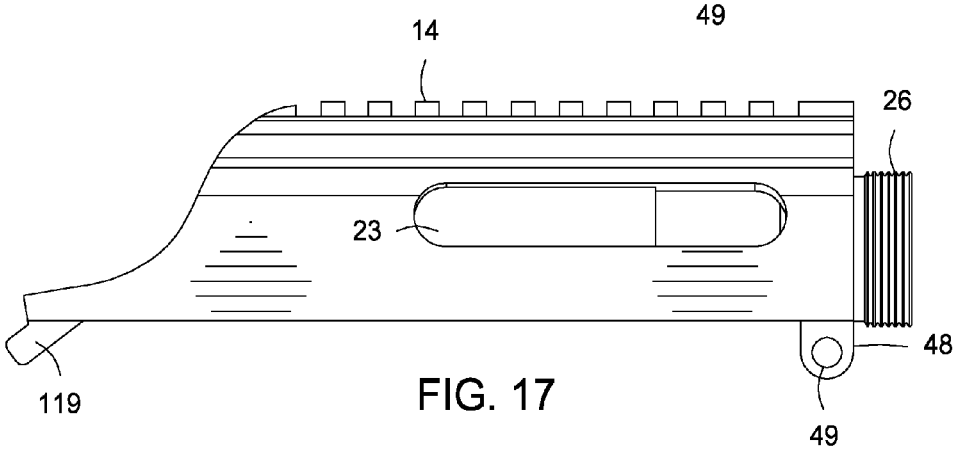
Figure 18:
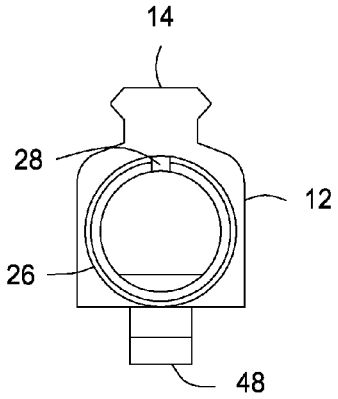
Figure 19:
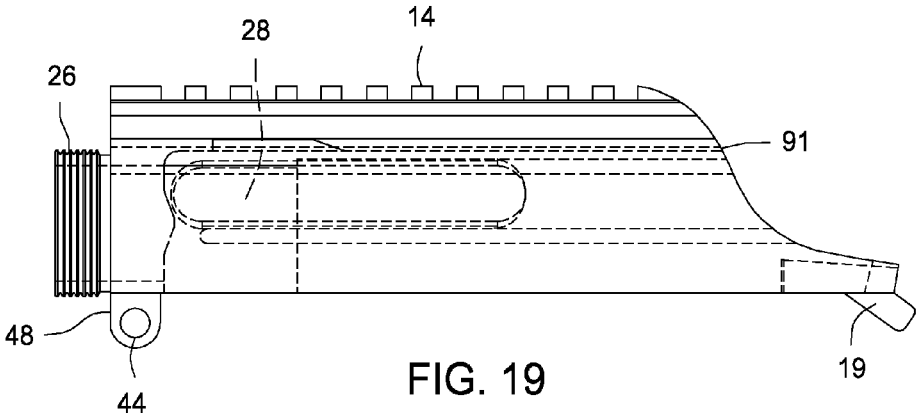

FIG. 1 is an isometric illustration showing a modular lever-action rifle that is constructed according to the principles of the present invention and represents the preferred embodiment of the invention;

FIG. 2 is a top view of the modular lever-action rifle of FIG. 1;

FIG. 3 is a left side elevation view of the modular lever-action rifle of FIGS. 1-3;

FIG. 4 is a bottom view of the modular lever-action rifle of FIGS. 1-3;

FIG. 5 is a front end view of the modular lever-action rifle of FIGS. 1-4;

FIG. 6 is a rear end view of the modular lever-action rifle of FIGS. 1-5;

FIG. 7 is a top view of an intermediate section of the lever-action rifle of FIGS. 1-6 particularly showing the upper receiver and sight mount rail thereof;

FIG. 8 is a side elevation view of the intermediate section of the lever-action rifle of FIG. 7;

FIG. 9 is a bottom view of the intermediate section of the lever-action rifle of FIGS. 7 and 8;

FIG. 10 is a side elevation view showing the intermediate section and particularly the upper and lower receivers of the lever-action rifle of FIGS. 1-9 with the lever-action mechanism being closed and locked;

FIG. 11 is an isometric illustration showing the lower receiver and showing the substantially square or rectangular cross-sectioned bolt carrier and bolt in the closed and locked position of the lever-action mechanism;

FIG. 12 is an isometric illustration similar to FIG. 11 and showing the lower receiver and magazine receptacle and further showing the lever-action mechanism being retracted and positioning the bolt carrier and bolt in the retracted position such as for cartridge extraction and ejection;

FIG. 13 is a side elevation view showing an intermediate section of the rifle of FIGS. 1-12 and identifying the position of the lever-action mechanism for closing and locking the bolt carrier member;

FIG. 14 is a side elevation view similar to FIG. 13 and showing the lever-action mechanism and the bolt carrier at intermediate lever-action positions such as occurs during cartridge case extraction or cartridge feeding from the magazine;

FIG. 15 is a side elevation view similar to FIGS. 13 and 14 showing the lever-action mechanism and the bolt carrier at fully retracted positions and ready for forward movement to pick up and charge a cartridge into the cartridge chamber of the rifle barrel;

FIG. 16 is an isometric illustration showing right side, top and front end portions of the upper receiver of the lever-action rifle of FIGS. 1-15;

FIG. 17 is a right side elevation view showing the upper receiver;

FIG. 18 is a front end view of the upper receiver;

FIG. 19 is a left side elevation view of the upper receiver

Figure 20:
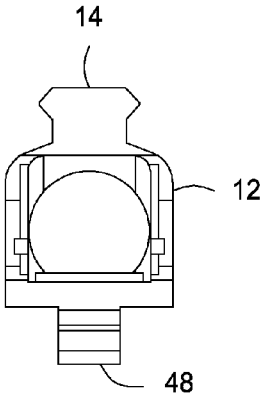
Figure 21:
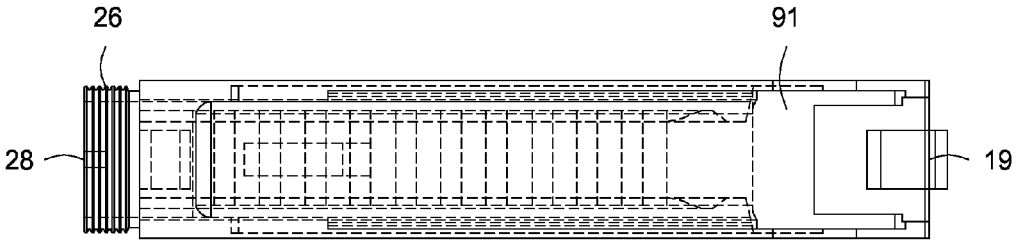
Figure 22:
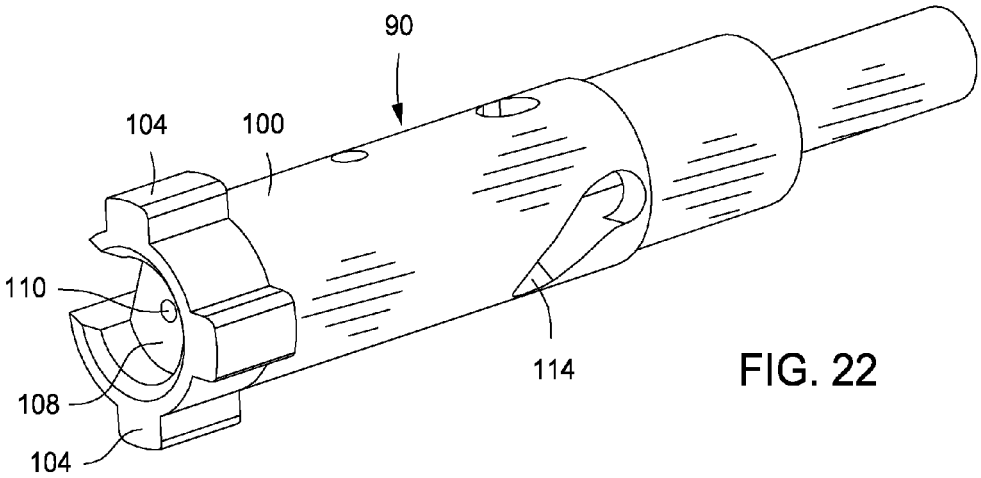
Figure 23:
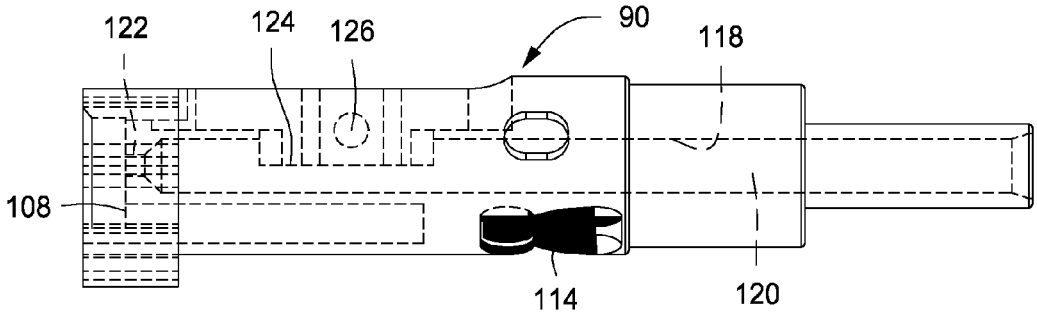
Figure 24:
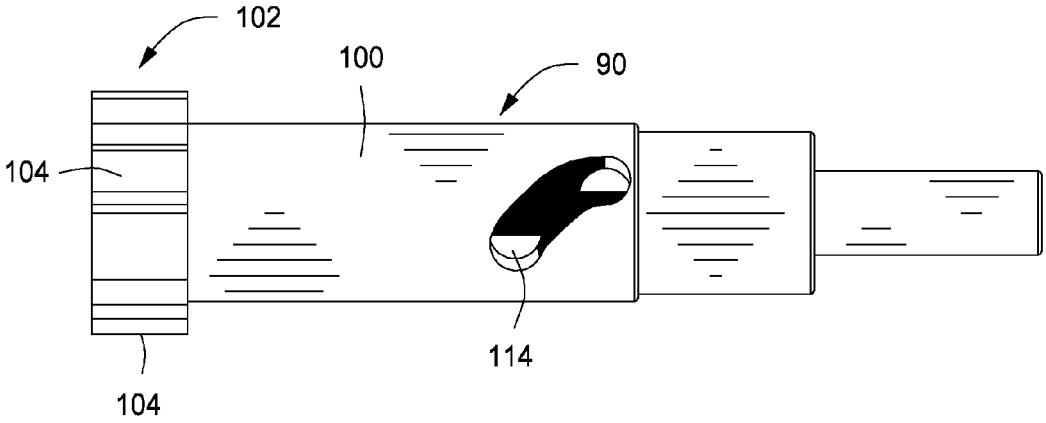
Figure 25:
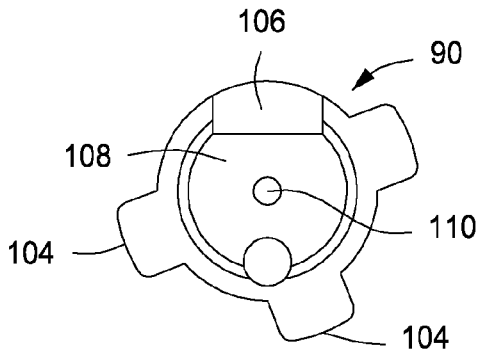
Figure 26:
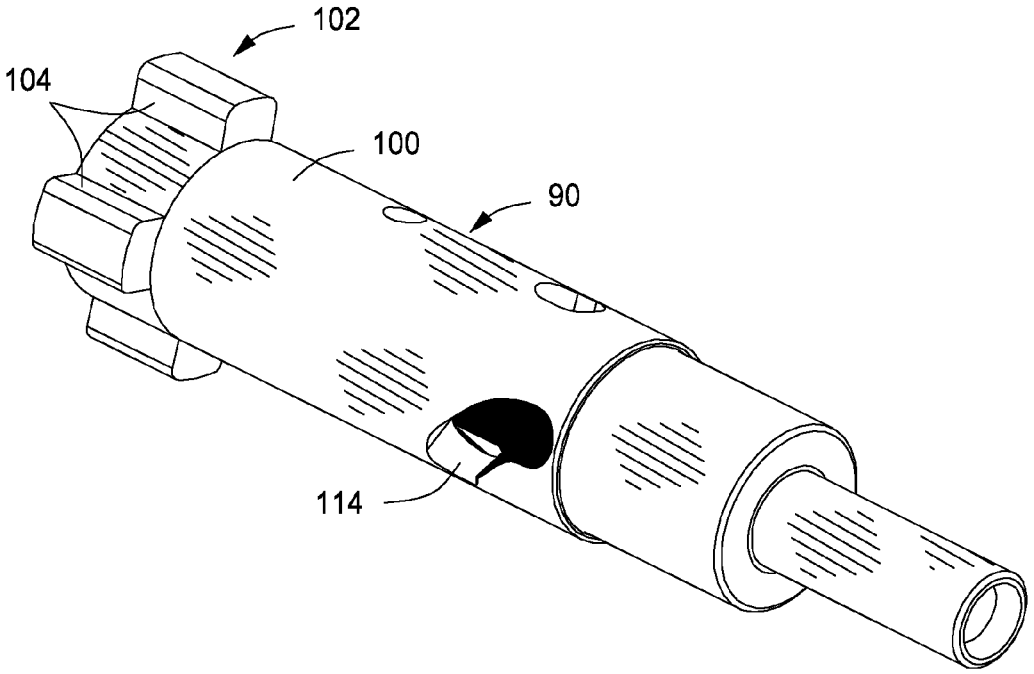
Figure 27:
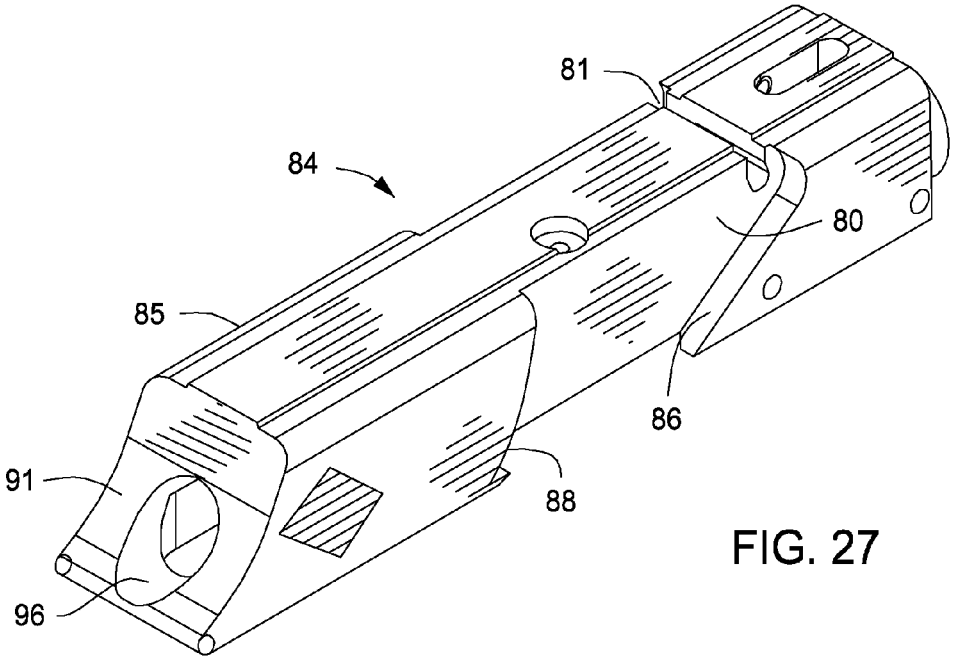
Figure 28:
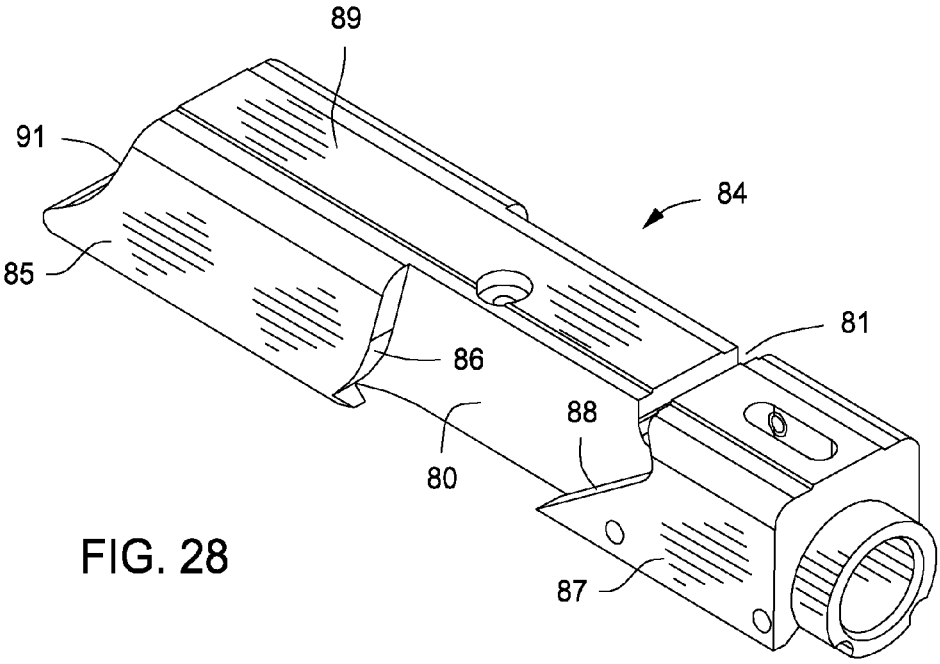

FIG. 20 is a rear end view of the upper receiver;

FIG. 21 is a bottom view of the upper receiver;

FIG. 22 is an isometric illustration showing the bolt and particularly identifying a cam pin slot for accomplishing bolt rotation during movement of the bolt carrier;

FIG. 23 is an elevation view further showing the details of the bolt carrier, within internal components thereof being presented in broken line;

FIG. 24 is an elevation view showing the external geometry of the bolt carrier and particularly identifying the configuration of the cam pin slot for rotational actuation of the bolt during bolt carrier movement;

FIG. 25 is a front end view of the bolt, showing the firing pin, cartridge extractor and cartridge ejector;

FIG. 26 is an isometric illustration particularly showing the rear geometry of the bolt member;

FIG. 27 is an isometric illustration showing rear, top and side portions of the bolt carrier and emphasizing its generally square or rectangular cross-sectional configuration; and FIG. 28 is an isometric illustration showing front, top and side portions of the bolt carrier.

DETAILED DESCRIPTION OF PREFERRED EMBODIMENT

Referring now to the drawings and first to the isometric illustration of FIGS. 1-6, a lever-action rifle having many of the features of the currently popular AR-15 type auto-loading rifle, is shown generally at 10 and has an upper receiver shown generally at 12 which defines an upper receiver cover or protective housing 13 on which is provided a sight mount rail 14. The sight mount rail may be machined integrally with the upper receiver or may be mounted to the upper receiver by screws of by any other suitable retainer devices. A wide range of mechanical and optical sighting devices, which are readily available on the current market may be removably mounted to the sight mount rail. The upper receiver housing 13 of the upper receiver 12 provides protection for upper receiver components and defines opposed side panels 15 that also serve to protect the upper receiver components. The upper receiver 12 is pivotally mounted to a lower receiver 16 by a mounting pin or pivot pin 18 that permits relative pivotal movement of the upper and lower receivers and is removable from aligned pivot pin receptacles to permit simple and efficient separation of the upper and lower receivers. As is evident in FIGS. 17, 19 and 21 an angulated tombstone type connector member 19 which is mounted to the upper receiver is received within a correspondingly angulated connection receptacle of the lower receiver to ensure that the upper and lower receivers are held in substantially immoveable assembly.

A butt-stock 20 is mounted to the lower receiver 16. Since the firearm 10 is designed particularly for use in rough and harsh conditions for sporting activities in the field, the butt-stock is preferably composed of a synthetic or composite material such as any of a number of polymer material or polymer composites that effectively maintain their shape, dimensions and thus accuracy during use in the harsh conditions that a utility rifle is likely to encounter. Typical wood stocks are known to be undesirable when subjected to hazardous conditions such as rain, snow, water, mud and the like. Though the butt-stock 20 is shown to be of the non-adjustable variety, it is to be borne in mind that the lower receiver may be adapted for mounting of an adjustable tactical style butt-stock mechanism of the general type that is shown in U.S. Pat. No. D679,772 without departing from the spirit and scope of the present invention.

A rifle barrel 22 and a hand-guard 24 are mounted to the upper receiver 12. The barrel is removably mounted to an externally threaded barrel mount 26 of the upper receiver, as shown in FIGS. 16 and 17 by means of a barrel retainer nut. An alignment pin of the barrel is received within a barrel alignment slot 28 of the threaded barrel mount 26 to ensure accurate positioning of the sight mount 14 and any sighting device that is mounted to the upper receiver. The upper receiver, as shown in FIGS. 16 and 17, defines a cartridge case ejection slot 23 which is located on the right side of the upper receiver. As the bolt carrier and bolt are cycled rearwardly by the lever-action mechanism, as will be explained in detrail below, spent cartridge cases are extracted from the cartridge chamber of the barrel, moved rearwardly by the bolt and ejected laterally through the cartridge case ejection slot 23. The hand-guard is retained in assembly with the upper received by a hand-guard retainer member 25 and includes a hand-guard stabilizing front end member 27 that has a circular inner flange member 29 defining a central opening within which a forward portion of the rifle barrel is received.

The forward portion of the lower receiver 16 defines a magazine retainer box 30 having an interior generally rectangular magazine receptacle 32 that is adapted to receive and releasably retain a removable AR type cartridge magazine 34. A magazine latch and release device 36 is mounted to the lower receiver and serves to latch and retain the cartridge magazine 34 properly positioned within the magazine receptacle 32 for cartridge pickup by the bolt and bolt carrier and when desired permits manually actuated release of the magazine for removal and replacement. A removable AR magazine will allow the user of the firearm to safely store cartridges within the firearm so that the cartridges are readily available for rapid loading, firing and ejection as desired. Since these types of cartridge magazines are readily available and fit a wide variety of firearms, including the AR-15 tactical rifles, the user of the firearm will be likely to have a number of loaded magazines available for ready access as desired. Moreover, these magazines can be used in other rifles of similar caliber to enhance the shooting experience of the user. The lower receiver 16 also defines a trigger guard 38 defining a trigger opening within which a trigger member 39 is positioned for firing actuation by the user of the firearm. The trigger member 39 and the hammer 112, both shown in FIG. 15, are component parts of a trigger mechanism that is mounted within the lower receiver 16 as a firing control mechanism for the firearm. The hammer is cocked and the trigger mechanism is set by rearward movement of the bolt carrier as shown in FIG. 15. Any of a number of commercially available trigger assemblies may be used as the firing control mechanism of the firearm of this invention.

As shown in detail in FIGS. 10 and 11 and also in FIGS. 18 and 20, the forward portion of the magazine retainer box 30 of the lower receiver 16 defines a pair of spaced forwardly extending pivot mount projections 40 and 42 that define aligned pivot pin apertures 44 and 46. As shown in FIGS. 16 and 17 the upper receiver 12 defines a centrally located downwardly extending pivot mount projection 48 that defines a pivot pin aperture 49. The pivot mount projection 48 is positioned within the space between the pivot mount projections 40 and 42 with the pivot pin apertures 44, 46 and 49 aligned and the pivot pin 18 is inserted through the aligned apertures to secure the upper and lower receivers in pivotal connection. When separation of the upper and lower receivers is desired, the pivot pin 18 is simply removed. A locking pin is inserted through aligned locking apertures of the upper and lower receivers to secure the receivers in locket assembly when the upper and lower receivers are at their operative positions as shown in FIGS. 1-4. The locking pin is inserted within the aligned locking apertures for locking of the upper and lower receivers against pivotal movement.

As shown in FIGS. 1, 3 and 4 and in greater detail in FIGS. 10 and 11, a lever-action mechanism shown generally at 50 is provided for pair of lever-action linkage members 52 and 54 that are each in juxtaposed relation with the opposed exterior generally planar recessed surfaces 56 that are defined by opposed shoulder surfaces 58 and 60 on each side of the lower receiver. A centrally located lever loop 62 is fixed to each of the lever-action linkage members 52 and 54 by screws 64 or other suitable retainer members that extend through the lever-action linkage members 52 and 54 and through spacer members 66 that are positioned between the linkage members 52 and 54 and the lever loop 62. The centrally located lever loop 62 defines a pivot projection 68 that defines a pivot receptacle 70 within which a lever pivot member 72 is received to establish pivotal movement of the lever-action linkage members 52 and 54 and the lever loop 62 relative to the lower receiver 16.

The bolt carrier mechanism shown generally at 84 has a bolt carrier body 85 that defines an internal bolt chamber within which a bolt member is moveable as explained in detail below. The bolt carrier body 85 is of generally rectangular or square cross-sectional configuration as is evident in FIGS. 31 and 32 and defines generally parallel and planar side surfaces 83 and 87 and have rounded corners at the juncture of the side surfaces with the top surface 89. A sloping concave rear end surface is defined by the bolt carrier body member 85. The rear end surface is intersected by a bolt opening 9 as shown in FIG. 27, the bolt opening being part of the internal chamber of the bolt carrier member.

The lever-action linkage members 52 and 54 each have bolt carrier actuating extremities one being shown at 74 in FIGS. 11-15 which are connected by a pivot members 76 to a rear end portion of a bolt carrier connection link 78. The forward end of the bolt carrier connection links 78 are mounted to opposed ends of a bolt carrier operating shaft 79 that is received within a transverse bolt carrier drive slot 81 of the bolt carrier body 85 as shown in FIG. 12 and in FIGS. 28-30. The intermediate recessed portion 82 of the bolt carrier mechanism 84 is defined by oppositely facing generally planar surfaces 80 and opposed bolt carrier shoulders 86 and 88 and within slots that are defined between the planar surfaces 80 and an inner surface of the cover or housing 13 of the upper receiver 12. The intermediate recessed portion of the bolt carrier permits the bolt connector link 78 to be positioned in surface to surface juxtaposition relative to the generally planar surface 80. The opposed side panels 15 of the upper receiver cover or housing 13 are spaced from the planar surfaces 80 of the intermediate recessed portions of the lower receiver, thus defining elongate slots 17 through which the upper portions of the lever-action linkages extend as shown in FIG. 8 It should be borne in mind that FIG. 11 shows the bolt carrier 84 in its forward-most position, such as when a cartridge has been loaded into the cartridge chamber and the bolt has been locked, while FIG. shows the bolt carrier at its rear-most position, such as at the end of its bolt unlocking and cartridge retraction and ejection movement.

Details of the bolt carrier are further shown in FIGS. 27 and 28 where it is clearly evident that the bolt carrier is provided with a generally square or rectangular cross-sectional configuration to permit its stability of guided reciprocating movement within the bolt carrier chamber of the upper receiver 12. The bolt carrier defines an internal bolt chamber within which a bolt mechanism shown generally at 90 is secured for controlled rotary movement to facilitate bolt head unlocking movement as the bolt carrier mechanism 84 is being moved rearwardly by the lever-action mechanism of the rifle.

Pairs of guide pins 92 and 94, one pair being shown in FIGS. 11 and 12, project laterally from the external portion of the bolt carrier 84 and are received within internal bolt carrier guide slots that are defined internally of the upper receiver member. The bolt carrier defines a generally circular forwardly extending flange that circumscribes a bolt opening 98. With reference to FIGS. 11, 12 and 23-26, the body shaft 100 of the bolt member extends through the bolt opening 98 and positions a bolt head 102 for cartridge engagement and locking. Locking lugs 104 extend outwardly from the bolt head and are positioned for entry into locking recesses that are located within the forward portion of the upper receiver. A cartridge extractor 106 is pivotally mounted to the bolt head and has an internal engagement flange that enters the circular rim groove of a cartridge case and serves to extract the cartridge case from the cartridge chamber of the barrel when the bolt member is moved rearwardly by rearward movement of the bolt carrier. The bolt head defines a cartridge recess 108 within which the rim of a center-fire cartridge is received and has a central opening 110 through which a firing pin is moved by the force of the hammer 112 when the trigger is manually moved to accomplish firing of the rifle mechanism.

As shown in FIGS. 23, 24 and 26, the bolt member 90 must be rotated prior to firing a round of ammunition to lock the bolt in place and prevent cartridge gas pressure from moving the cartridge case rearwardly when the cartridge is fired. After firing, the bolt must be rotated for unlocking, so that the lever-action mechanism can be actuated to extract and eject the spent cartridge case. The body structure 100 of the bolt member defines opposed locking and unlocking openings 114 generally called cam pin slots having a curved geometry defining cam type surfaces or edges. Cam pins 116 are threaded into the bolt carrier member and have inner rotational control portions that engage within the cam pin slots. As the bolt carrier is moved linearly either forwardly or rearwardly to or from the locked position of the bolt head 90 the cam pins interact with the cam surfaces or edges of the cam slots and cause rotation of the bolt head either to its locked position or from its locked position, depending on the direction of bolt carrier movement by the lever-action mechanism. The mechanical reaction of the cam pins within the cam slots of the bolt member cause substantially 45° rotation of the bolt member for locking and unlocking movement in response to linear movement by the bolt carrier by the lever-action mechanism.

As shown in broken line in FIG. 23, the bolt member 90 defines an internal centrally located firing pin passage or receptacle 118 having a firing pin 120 therein. The firing pin defines a primer striking pin member 122 which is moveable within the central opening 110, shown in FIG. 25, to strike, depress and ignite the primer of a center-fire cartridge when the firing pin is suddenly moved forward by the spring urged striking force of the hammer 112 during firing activity when the hammer is released by the trigger mechanism. The firing pin 120 defines an intermediate recess 124 within which is positioned a retention pin 126 that permits the necessary linear movement of the firing pin within the firing pin passage or receptacle 118 and prevents separation of the firing pin from the firing pin passage or receptacle 118.

Operation

With the firearm of the present invention in the firing condition shown in FIGS. 1-6, a cartridge magazine 34 containing a number of center-fire ammunition cartridges is inserted into the magazine receptacle 32 of the magazine retainer box 30. The lever action mechanism 50 is cycled by first pivotally moving the lever loop 62 downwardly causing the lever-action linkage members 52-54 and 78 to impart rearward force to the bolt carrier. Since the bolt head will be in its locked position relative to the barrel of the firearm at this point, the bolt mechanism 90 will not be moved rearwardly, but the cam pin or pins 116 of the bolt carrier will have camming reaction within the cam slot or slots 114 of the tubular body shaft 100 of the bolt, causing substantially 45° rotation of the bolt and its bolt head from the locked position to the unlocked position.

When the bolt mechanism 90 has been unlocked the bolt will be moved rearwardly along with the bolt carrier body 85 within the bolt carrier chamber that is defined by the upper receiver. During this rearward movement of the bolt carrier the hammer 112 is pivoted rearwardly to its cocked position by the bolt carrier, causing further loading of the hammer spring. Also during this rearward movement of the bolt carrier, if a cartridge or cartridge case is present within the cartridge chamber of the barrel, the extractor of the bolt head will be in engagement with the rim of the cartridge case and will serve to extract the cartridge case from the cartridge chamber and move it rearwardly. During this rearward movement of the bolt carrier and bolt the cartridge case will be ejected laterally and rearwardly through the ejection port 23 of the upper receiver.

From the rearmost position of the bolt carrier and bolt, the lever-action mechanism 50 is actuated with the lever-action loop 62 being manually moved from the open position shown in FIG. 12 toward the closed position shown in FIG. 13. During this closing or cartridge loading movement the driving linkage of the lever-action mechanism imparts forwardly directed force to the bolt carrier member, moving the bolt carrier forwardly within the bolt carrier chamber of the upper receiver and along the guide rails 95 of the lower receiver. During this forward movement the bolt head 102 will contact the uppermost cartridge of the cartridge magazine and will strip the cartridge from the magazine and move it forwardly and into the cartridge chamber of the barrel 22. The base of the cartridge will be located within the circular recess 108 of the bolt head, positioning the primer of the cartridge base opposite the firing pin opening 110.

During the later stage of forward movement of the bolt carrier and bolt mechanism the bolt head will enter the locking receptacle adjacent the cartridge chamber of the barrel and forward movement of the bolt mechanism will be stopped by the bottom surface of the locking recess. Continued forward movement of the bolt carrier causes the cam pin or pins 116 to react with the geometry of the cam slots 114 of the body shaft 100 of the bolt mechanism, causing substantially 45° rotation of the bolt head to its locking position wherein the locking lugs are seated within locking recesses of the locking receptacle. At this point in the lever-action cycle the trigger may be manually actuated causing the trigger mechanism to release the hammer for spring energized movement for striking the firing pin and driving the forward end of the firing pin from the opening 110 and into the primer for firing the cartridge that is seated within the cartridge chamber. If desired, however, the trigger bar safety may be manually positioned at its safe position, preventing sufficient movement of the trigger for firing actuation of the trigger mechanism. The firearm will be prevented from firing by the trigger bar safety until such time as the safety has been manually moved to its firing position.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

We claim:

1. A lever-action firearm, comprising:

an upper receiver having a rifle barrel mounted thereto and defining a first pivot mount, said barrel defining a cartridge chamber;

a bolt mechanism being located for reciprocating movement within said upper receiver;

a cartridge magazine being releasably received by said lower receiver and positioning a cartridge for movement into said cartridge chamber during forward movement of said bolt mechanism;

a lower receiver defining a second pivot mount;

a pivot member engaging said first and second pivot mounts and securing said upper and lower receivers in pivotal connection; and a lever-action mechanism being mounted to said lower receiver and having operating connection with said bolt mechanism for imparting substantially linear movement of said bolt mechanism responsive to manual action of said lever-action mechanism, said lever-action mechanism being movably mounted to said lower receiver and having a pair of linkage arms extending along external surface portions of said lower receiver and into said upper receiver, said linkage arms having driving connection with said bolt mechanism and moving said bolt mechanism substantially linearly responsive to manual actuation of said lever-action mechanism.

2. The lever-action firearm of claim 1, comprising:

an cartridge magazine receptacle being defined by said lower receiver; and an cartridge magazine being releasably received by said cartridge magazine receptacle and during shooting activities providing a number of ammunition cartridges and positioning an uppermost one of the ammunition cartridges for pick-up by forward movement of said bolt mechanism by said lever-action mechanism.

3. The lever-action firearm of claim 1, said bolt mechanism comprising:

a bolt carrier being located for substantially linear reciprocating movement within said upper receiver and being in assembly with said lever-action mechanism;

substantially parallel guide slots being provided on said bolt carrier and having guided engagement with a guide rails of said lower receiver; and a bolt mechanism being moveable within said bolt carrier and having a bolt head defining locking lugs and a cartridge recess within which the base of a cartridge is received.

4. The lever-action firearm of claim 3, comprising:

a cam slot being defined by said bolt mechanism; and a cam pin of said bolt carrier being engaged within said cam slot and reacting with said cam slot during substantially linear movement of said bolt carrier and causing rotational movement of said bolt mechanism for locking and unlocking movement of said bolt head.

5. The lever-action firearm of claim 3, comprising:

said bolt carrier defining front and rear ends and having a generally rectangular cross-sectional configuration, said bolt carrier defining an internal bolt chamber intersecting said front and rear ends of said bolt carrier;

said bolt mechanism having an elongate bolt body defining a firing pin passage and having a bolt head projecting forwardly of said bolt carrier and having locking lugs and defining a firing pin opening;

a firing pin being movably contained within said firing pin passage a cam slot being defined by said bolt mechanism; and a cam pin being threaded into said bolt carrier and having an inner bolt actuating portion being engaged within said cam slot and reacting with said cam slot during substantially linear movement of said bolt carrier by said lever-action mechanism and causing rotational movement of said bolt mechanism for locking and unlocking movement of said bolt head relative to a bolt locking receptacle of said lever-action firearm.

6. The lever-action firearm of claim 1, comprising:

said lower receiver having opposed recesses defined by outwardly facing recessed surfaces on each side of said lower receiver;

said lever action mechanism having a pair of drive linkages each being moveable within one of said opposed lower receiver recesses; and said bolt mechanism having a bolt carrier defining opposed bolt carrier recesses having portions of said drive linkages moveable therein and having driving connection with said bolt carrier for reciprocation of said bolt carrier responsive to manual actuation of said lever-action mechanism.

7. The lever-action firearm of claim 6, comprising:

a lever loop being mounted in pivotal relation with said lower receiver;

first drive linkage members being fixed to said lever loop and each being moveable within said opposed recesses of said lower receiver; and second drive linkage members each being moveable within said opposed bolt carrier recesses said having driven connection with one of said first drive linkage members and having driving connection with said bolt carrier.

8. The lever-action firearm of claim 7, comprising:

opposed intermediate recesses being defined by said lower receiver; and side panels being defined by said upper receiver and being spaced from said opposed intermediate recesses and defining elongate slots through which portions of said first and second drive linkage members extend into said upper receiver.

9. The lever-action firearm of claim 7, comprising:

said bolt carrier defining a transverse drive slot;

a bolt carrier drive shaft having end portions each being connected with one of said second drive linkage members and said bolt carrier drive shaft having driving engagement within said transverse drive slot; and said upper receiver defining a receiver housing enclosing and guiding reciprocating movement of said bolt carrier and retaining said bolt carrier drive shaft within said transverse drive slot.

10. The lever-action firearm of claim 1, comprising:

said lower receiver defining a connection receptacle; and a connection member being fixed to said upper receiver and having connecting engagement within said connection receptacle and securing said upper and lower receivers in substantially immoveable assembly.

11. A lever-action firearm, comprising:

an upper receiver having a rifle barrel mounted thereto and defining a first pivot mount, said upper receiver defining a protective housing having side panels;

a lower receiver defining external side surfaces and having a second pivot mount;

said side panels being disposed in spaced relation with portions of said external side surfaces of said lower receiver and defining elongate linkage slots;

a pivot member engaging said first and second pivot mounts and securing said upper and lower receivers in pivotal connection; and a lever-action mechanism being movably mounted to said lower receiver and having drive linkages extending along said external side surfaces and through said elongate linkage slots; and bolt carrier and bolt mechanisms being substantially linearly moveable within said protective housing of said upper receiver and having driven engagement by said drive linkages of said lever-action mechanism.

12. The lever-action firearm of claim 11, comprising:

a cartridge magazine receptacle being defined by said lower receiver; and a cartridge magazine being releasably received by said cartridge magazine receptacle and during shooting activities providing a number of ammunition cartridges and positioning an uppermost one of the ammunition cartridges for pick-up by forward movement of said bolt carrier and bolt mechanisms by said lever-action mechanism.

13. The lever-action firearm of claim 11, comprising:

a bolt carrier being located for substantially linear reciprocating movement within said upper receiver and being in assembly with said lever-action mechanism;

substantially parallel guide slots being provided on said bolt carrier and having guided engagement with a guide rails of said lower receiver;

a bolt mechanism being moveable within said bolt carrier and having a bolt head defining locking lugs and a cartridge recess within which the base of a cartridge is received a cam slot being defined by said bolt mechanism; and a cam pin of said bolt carrier being engaged within said cam slot and reacting with said cam slot during substantially linear movement of said bolt carrier and causing rotational movement of said bolt mechanism for locking and unlocking movement of said bolt head.

14. The lever-action firearm of claim 13, comprising:

said bolt carrier defining front and rear ends and having a generally rectangular cross-sectional configuration, said bolt carrier defining an internal bolt chamber intersecting said front and rear ends of said bolt carrier;

said bolt mechanism having an elongate bolt body defining a firing pin passage and having a bolt head projecting forwardly of said bolt carrier and having locking lugs and defining a firing pin opening;

a firing pin being movably contained within said firing pin passage a cam slot being defined by said bolt mechanism; and a cam pin being threaded into said bolt carrier and having an inner bolt actuating portion being engaged within said cam slot and reacting with said cam slot during substantially linear movement of said bolt carrier by said lever-action mechanism and causing rotational movement of said bolt mechanism for locking and unlocking movement of said bolt head relative to a bolt locking receptacle of said lever-action firearm.

15. The lever-action firearm of claim 11, comprising:

said lower receiver having opposed recesses defined by outwardly facing recessed surfaces on each side of said lower receiver;

said lever action mechanism having a pair of drive linkages each being moveable within one of said opposed lower receiver recesses;

said bolt mechanism having a bolt carrier defining opposed bolt carrier recesses having portions of said drive linkages moveable therein and having driving connection with said bolt carrier for reciprocation of said bolt carrier responsive to manual actuation of said lever-action mechanism;

a lever loop being mounted in pivotal relation with said lower receiver;

first drive linkage members being fixed to said lever loop and each being moveable within said opposed recesses of said lower receiver; and second drive linkage members each being moveable within said opposed bolt carrier recesses said having driven connection with one of said first drive linkage members and having driving connection with said bolt carrier.

16. The lever-action firearm of claim 11, comprising:

opposed intermediate recesses being defined by said lower receiver; and side panels being defined by said upper receiver and being spaced from said opposed intermediate recesses and defining elongate slots through which portions of said first and second drive linkage members extend into said upper receiver.

* * * * *